US007926467B2

(12) United States Patent
Theodorof

(10) Patent No.: US 7,926,467 B2
(45) Date of Patent: Apr. 19, 2011

(54) DROPLET GENERATOR FOR ENGINE SYSTEM

(75) Inventor: Vladimir Theodorof, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 1022 days.

(21) Appl. No.: 11/797,016

(22) Filed: Apr. 30, 2007

(65) Prior Publication Data

US 2008/0265051 A1 Oct. 30, 2008

(51) Int. Cl.
*F02M 51/06* (2006.01)
*B05B 1/08* (2006.01)
*F01N 3/00* (2006.01)

(52) U.S. Cl. ..... 123/472

(58) Field of Classification Search ..... 123/472, 123/547, 549, 478, 295, 298, 305; 239/533.3, 239/533.11, 533.12, 4, 102.2; 60/295
See application file for complete search history.

(56) References Cited

U.S. PATENT DOCUMENTS

| | | | | |
|---|---|---|---|---|
| 2,414,494 A | | 1/1947 | Vang | |
| 3,625,190 A | * | 12/1971 | Boissevain | 123/547 |
| 3,739,393 A | | 6/1973 | Lyon et al. | |
| 3,756,575 A | | 9/1973 | Cottell | |
| 3,860,173 A | | 1/1975 | Sata | |
| 3,977,383 A | | 8/1976 | Nagumo | |
| 4,052,004 A | | 10/1977 | Martin et al. | |
| 4,186,708 A | * | 2/1980 | Bowler | 123/472 |
| 4,193,009 A | | 3/1980 | Durley, III | |
| 4,393,991 A | | 7/1983 | Jeffras et al. | |
| 4,418,672 A | | 12/1983 | Müller et al. | |
| 4,452,396 A | * | 6/1984 | Cataldo | 239/223 |
| 4,799,622 A | | 1/1989 | Ishikawa et al. | |
| 5,099,815 A | | 3/1992 | Yamauchi et al. | |
| 5,248,087 A | | 9/1993 | Dressler | |
| 5,392,988 A | | 2/1995 | Thayer, III | |
| 6,148,792 A | * | 11/2000 | Hei Ma | 123/298 |
| 6,196,219 B1 | | 3/2001 | Hess et al. | |
| 6,540,153 B1 | | 4/2003 | Ivri | |
| 6,722,582 B2 | | 4/2004 | Hess et al. | |
| 2004/0080242 A1 | | 4/2004 | Ohnishi et al. | |

FOREIGN PATENT DOCUMENTS

| | | | |
|---|---|---|---|
| DE | 36 33 949 A1 | * | 4/1988 |
| DE | 19646643 | | 2/1998 |
| EP | 0 256 750 A2 | | 2/1988 |
| GB | 1102472 | | 2/1968 |

OTHER PUBLICATIONS de Heji B., et al., "Modelling and Optimisation of A Vaporiser For Inhalation Drug Therapy," Microflow Engineering SA.

* cited by examiner

*Primary Examiner* — Hieu T Vo
(74) *Attorney, Agent, or Firm* — Finnegan, Henderson, Farabow, Garrett & Dunner LLP

(57) ABSTRACT

An engine system includes an intake system, an internal combustion engine, and an exhaust system. The internal combustion engine includes a fuel droplet generator, and a fuel injector configured to inject fuel directly into a combustion chamber of the internal combustion engine.

22 Claims, 2 Drawing Sheets

DROPLET GENERATOR FOR ENGINE SYSTEM

TECHNICAL FIELD

The present disclosure is directed to an engine system, and more particularly, to an engine system using a droplet generator.

BACKGROUND

Engines, including diesel engines, gasoline engines, natural gas engines, and other engines known in the art, may exhaust a complex mixture of air pollutants. The air pollutants may be composed of both solid material, such as, for example, particulate matter, and gaseous material, which may include, for example, oxides of nitrogen, such as $NO_2$ and $NO_3$ (commonly referred to collectively as "$NO_x$").

Due to increased environmental concerns, exhaust emission standards have become more stringent. The amount of particulate matter and gaseous pollutants emitted from an engine may be regulated depending on the type, size, and/or class of engine. In order to meet these emissions standards, engine manufacturers have pursued improvements in several different engine technologies, such as fuel injection, engine management, and aftertreatment to name a few.

For example, it has been recognized that a more homogeneous mixture of fuel and air in a combustion chamber can lead to more efficient combustion, resulting in reduced engine emissions. U.S. Pat. No. 4,052,004 ("the '004 patent") issued to Martin et al. discloses a vibratory atomizer for atomizing a fuel delivered to an engine. The atomizer includes a piezoelectric crystal that serves to vibrate a nozzle and body portion of the device so that fuel leaves through a single outlet by way of the nozzle in a finely atomized form. While the atomizer of the '004 patent does deliver a finely atomized fuel to an engine, the shape of the nozzle of the '004 patent tapers down toward its outlet and thus serves to consolidate the atomized fuel rather than disburse the fuel toward a more homogeneous mixture with the air. Further, the '004 patent does not disclose using the atomizer in connection with engine aftertreatment.

The present disclosure is directed at solving one or more of the deficiencies discussed above.

SUMMARY OF THE INVENTION

In one aspect, the present disclosure is directed to an engine system including an intake system, an internal combustion engine, and an exhaust system. The internal combustion engine includes a fuel droplet generator, and a fuel injector configured to inject fuel directly into a combustion chamber of the internal combustion engine.

In another aspect, an exhaust system of an engine system includes a piezo actuated droplet generator and an aftertreatment device. The aftertreatment device is located downstream of the piezo droplet generator.

In yet another aspect, the present disclosure includes a method of operating an engine system including supplying fuel from a droplet generator to a combustion chamber of an internal combustion engine. The method further includes supplying fuel from a fuel injector to a combustion chamber of an internal combustion engine.

In another aspect, a method of operating an engine system includes supplying reagent from a piezo actuated droplet generator to engine exhaust. The method further includes supplying a mixture of reagent and engine exhaust to an aftertreatment device.

DETAILED DESCRIPTION

Figure 1:
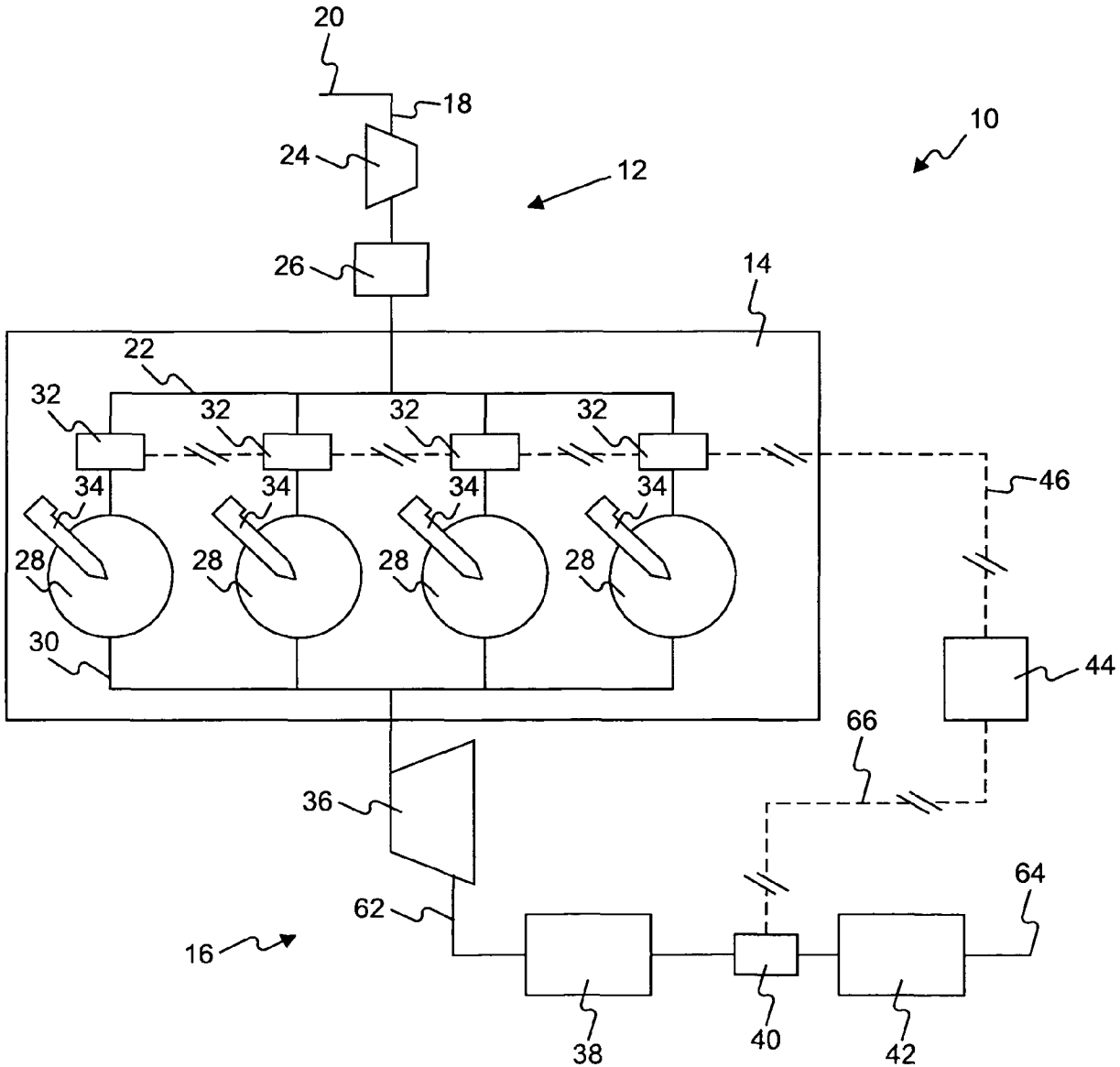
FIG. 1 is a diagrammatic illustration of an engine system according to an exemplary disclosed embodiment.

FIG. 1 illustrates an engine system 10. Engine system 10 may include an intake system 12, an internal combustion engine 14, and an exhaust system 16. Intake system 12 may include conventional components, such as, for example, an air inlet passageway 18 running from an ambient air inlet 20 to an intake manifold 22 of the engine 14. The air inlet passageway 18 may include a compressor 24 and an air cooler 26. The compressor 24 may be part of a turbocharger of the engine system 10. It is contemplated that additional and/or different components may be included within intake system 12 such as, for example, a controllable valve (not shown) for allowing a flow of engine exhaust gas into the inlet passageway 18, an air filter (not shown), and/or an additional compressor (not shown).

The internal combustion engine 14 may be a diesel engine, a gasoline engine, a gaseous fuel powered engine, or any other type of engine. The engine 14 may include the intake manifold 22, a plurality of combustion chambers 28, and an exhaust manifold 30. Fuel injectors 34 may be associated with each combustion chamber 28 to directly inject fuel into a respective combustion chamber 28. The engine 14 depicted in FIG. 1 includes four combustion chambers 28, however, the engine 14 may include more or less combustion chambers 28. In addition, the combustion chambers 28 may be disposed in an "in-line" configuration (as shown) or in a "V" configuration, or any other suitable configuration. It is understood that injectors 34 may be omitted, and spark plugs added, in an embodiment of the present disclosure where the engine 14 is a gasoline engine.

Engine 14 may also include one or more piezo droplet generators 32. A piezo droplet generator 32 may be located upstream of each combustion chamber 28, and in particular, may be located within the inlet manifold 22 at a portion of the inlet manifold 22 associated with individual combustion chambers 28. While FIG. 1 shows a single piezo droplet generator 32 associated with each combustion chamber 28, more than one generator 32 may be associated with each combustion chamber 28. Further, it is understood that piezo droplet generators 32 may be located at other locations upstream of the inlet of a respective combustion chamber 28. Piezo droplet generator 32 may be secured to engine 14 in any conventional manner. As will be explained in more detail below, piezo droplet generators may be actuated by a current supplied from a controller 44 via electrical line 46.

Figure 2:
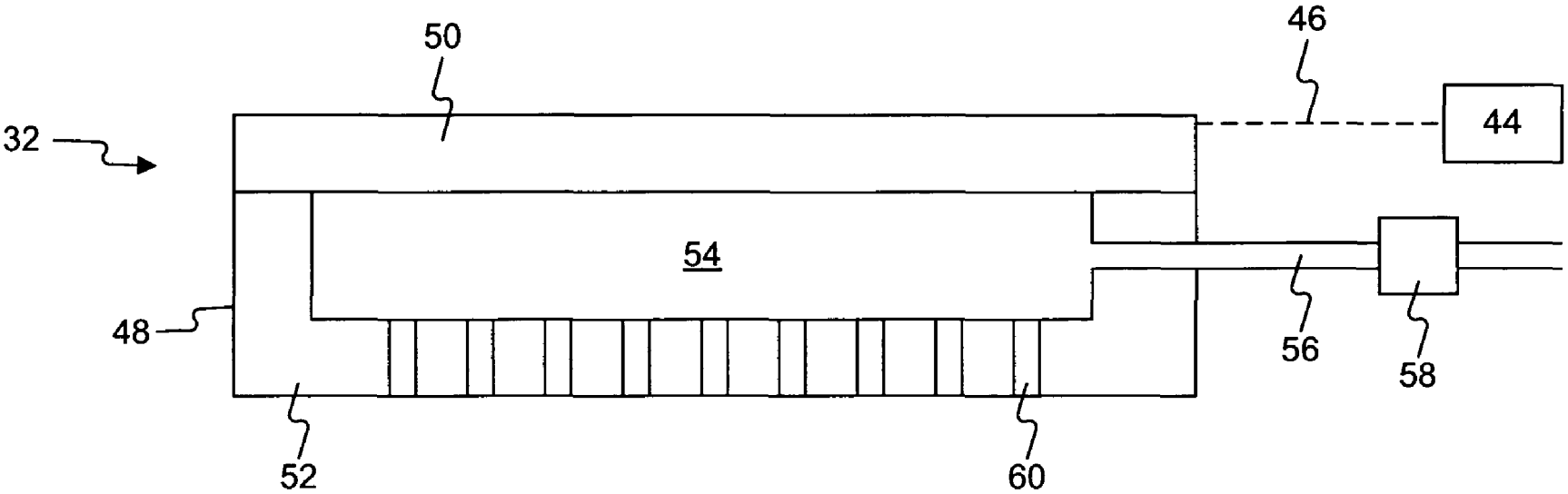
FIG. 2 is a schematic representation of a piezo actuator of the engine system of FIG. 1.

Referring to FIG. 2, piezo droplet generator 32 may be of conventional form including, for example, a droplet generator housing 48 including a piezo sheet/actuator 50 and a substantially planar injection element 52 having a plurality of outlet holes 60. A droplet generator similar in structure to piezo droplet generator 32 is manufactured by Microflow Engineering SA of Neushatel Switzerland. A side of droplet generator housing 48 may include an inlet conduit 56 and inlet valve 58. Inlet conduit 56 of piezo droplet generator 32 may be coupled between a fuel chamber 54 formed within the droplet generator housing 48, and a supply of fuel (not shown). Inlet valve 58 may be of any conventional form, such as a ball check valve, or alternatively, inlet valve 58 may be omitted. The piezo droplet generator 32 is different than conventional fuel injectors at least by the fact that the droplet generator 32 is not formed with a single nozzle assembly.

Piezo actuator 50 may be formed entirely or partially of piezo material, such as piezoelectric material or piezoceramic material. Further, piezo actuator 50 may be a separate element coupled to a member forming a portion of the fuel chamber 54. The piezo actuator 50 of the piezo droplet generator 32 may be physically connected to the controller 44 through electric line 46 to receive current from controller 44.

The number and size of piezo droplet generators 32 may be selected based on the desired amount of fuel to be supplied to the combustion chambers 28, while taking into account any limitations associated with the components of the generator 32 and constraints of the engine 14. In an exemplary embodiment, the outlet holes 60 of the injection element 52 may be configured so as to provide to the engine 14 with droplets having a size of approximately 8 microns. In another exemplary embodiment, the outlet holes 60 may be spaced to provide approximately 1220 outlet holes 60 per square centimeter of the injection element 52. It is contemplated that outlet holes 60 may be configured to provide droplets having other sizes, such as less than 8 microns, and may be spaced with a different distribution, such as less than 1220 holes per square centimeter.

Referring back to FIG. 1, exhaust system 16 may include an exhaust passageway 62 extending from the exhaust manifold 30 of engine 14 to an engine system exhaust outlet 64. Exhaust passageway 62 may include a turbine 36, a particulate filter 38, an exhaust-side piezo droplet generator 40, and a catalyst-based device 42. Alternative or additional components or arrangements may be included in exhaust system 16. For example, the turbine 36 may be omitted and/or an exhaust gas recirculation circuit (not shown) and one or more after-treatment devices (not shown) may be added to exhaust system 16.

The turbine 36 of the exhaust system 16 may be of the fixed geometry or variable geometry type, and may make up part of a turbocharger system with compressor 24. An additional turbine (not shown) may be added to exhaust system 16, either in series or in parallel with turbine 36. An appropriate wastegate system (not shown) may also be included in exhaust system 16.

Particulate filter 38 may be disposed downstream of turbine 36 and may include a filter medium configured to trap particulate matter as engine exhaust flows through it. The filter medium may include a mesh-like material, a porous ceramic material (e.g., cordierite), or any other material and/or configuration suitable for trapping particulate matter.

Catalyst-based device 42 may be located downstream of particulate filter 38 and may include a catalyst, a NOx adsorber, a NOx absorber, or any other denitration device known in the art. For example, catalyst-based device 42 may include one or more substrates coated with or otherwise containing a liquid or gaseous catalyst such as a precious metal. The catalyst may reduce the by-products of combustion in the engine exhaust by way of, for example, selective catalytic reduction. In one example, a reagent in the form of urea may be injected by exhaust-side piezo droplet generator 40 into the exhaust passageway 62 upstream of catalyst-based device 42. The urea reagent injected to the catalyst-based device 42 may decompose to ammonia, which may react with the NOx in the engine exhaust across the catalyst to form $H_2O$ and N2.

The exhaust-side piezo droplet generator 40 may be configured in the same manner as the piezo droplet generator 32 coupled to the engine 14 (FIG. 2), with the exception that the outlet holes 60 of the exhaust-side generator 40 would be sized for the particular fluid being injected (e.g., urea). For example, the outlet holes 60 of the exhaust-side piezo droplet generator 40 may be sized to supply the catalyst-based device 42 with urea droplets having an approximate size in an exemplary embodiment of 25 microns. The exhaust-side piezo droplet generator 40 may be coupled to the exhaust passageway 62 upstream of the catalyst-based device 42 (as shown), or alternatively directly coupled to an upstream side of the catalyst-based device 42. Similar to the piezo droplet generator 32, exhaust-side piezo droplet generator 40 is controlled by controller 44 that supplies current to the generator 40 through electrical lines 66. It is contemplated that outlet holes 60 may be sized to supply the catalyst-based device 42 with urea droplets having other sizes, such as less than 25 microns. It is understood that exhaust-side piezo droplet generator 40 may be specially configured for the high-heat environment of the exhaust system 16.

Controller 44 may include any component configured to receive engine and/or machine operating parameter-related information and/or monitor, record, store, index, process, and/or communicate such information and additional information. For example, controller 44 may include a memory, one or more data storage devices, a central processing unit, and/or any other components that may be used to run an application. Various known circuits may be associated with controller 44, such as power supply circuitry, signal-conditioning circuitry, solenoid driver circuitry, communication circuitry, and other appropriate circuitry.

Controller 44 may be configured to perform multiple processing and controlling functions, such as, for example, engine management (e.g., controller 44 may include an engine control module, a.k.a. an ECM), monitoring/calculating various parameters related to exhaust output and after-treatment thereof, etc. In particular, controller 44 may be configured to determine the timing and duration of a current supplied over electrical line 46 to the piezo droplet generator 32 of engine 14 based on certain engine system conditions. For example, a current may be supplied to piezo droplet generator 32 during engine idle conditions to supplement or replace fuel provided by fuel injector 28, or supplied to generator 32 so as to deliver fuel to the combustion chamber 28 during a portion or all of a fuel cycle (e.g., pilot, main, and/or post injections). Further, controller 44 may be particularly configured to determine the timing and duration of current supply to exhaust-side piezo generator 40 based on certain engine system conditions. For example, controller 44 may determine when and how long to send a current along electrical line 66 to exhaust-side piezo droplet generator 40 to maintain an appropriate amount of ammonia in catalyst-based device 42.

Operation of engine system 10 may include receiving air into inlet passageway 18 via ambient air inlet 20. The air in inlet passageway 18 may then be increased in pressure by compressor 24 and thereafter cooled by air cooler 26. The cool, charged air may then enter engine 14 through the intake manifold 22. Prior to entering the combustion chambers 28 of engine 14, the cooled, charged air may be mixed with fuel by way of piezo droplet generator 32. In particular, controller 44 determines the appropriate timing and duration of an actuation of piezo actuator 50 of piezo droplet generator 32, based on, for example, engine system operating conditions. Upon receiving a controlled current from controller 44, piezo droplet generator 32, and in particular, piezo actuator 50 (FIG. 2), oscillates at a high frequency so as to draw fuel into fuel chamber 54 through inlet conduit 56 and expel fluid from the fuel chamber 54 through outlet holes 60. Exemplary timings and durations for injection of fuel by piezo droplet generator 32 may include during engine idle conditions, and/or during a portion or all of a fuel delivery cycle, such as during a pilot, main, and/or post injection event. After the air and fuel mixture enters combustion chamber 28, any remaining fuel required for desired combustion is injected into the combustion chamber by fuel injectors 28. Thereafter, combustion of the fuel/air mixture in the combustion chamber is initiated.

After a power stroke of the engine 14, the engine exhaust is caused to exit the engine 14 by way of exhaust manifold 30. From there, the exhaust may travel to exhaust system 16, and more particularly to exhaust passageway 62. The exhaust may expanded by way of turbine 36 and filtered by particulate filter 38. If engine system parameters dictate, controller 44 may supply a controlled current over electric line 66 to actuate exhaust-side piezo droplet generator 40 to inject urea into the engine exhaust and thus supply urea to catalyst-based device 42. Injection of urea by exhaust-side piezo droplet generator 40 may be initiated by controller 44 determining that more ammonia is necessary in catalyst-based device 42 to maintain a sufficient amount of chemical reaction between the catalyst-based device 42 and the engine exhaust.

Once the filtered, reacted engine exhaust leaves the catalyst-based device 42, the engine exhaust exits the engine system 10 through the exhaust outlet 64. After exiting the engine system 10, the exhaust may be otherwise conditioned and eventually exit to the atmosphere.

It is understood that while FIG. 1 illustrates an engine system 10 including both an intake-side piezo droplet generator 32 in engine 14 and an exhaust-side piezo droplet generator 40, one or the other generators 32, 40 may be omitted from engine system 10 while still being within the present disclosure.

The use of a piezo droplet generator 32 in engine 14 may provide for a reduction in fuel droplet size in combustion chamber 28, which may result in improved emissions. The smaller droplet size (e.g., less than 7 microns) allows for better mixing of the fuel and air within the combustion chamber 28. A better mix of fuel and air reduces the number of "hot spots" during combustion that can cause additional, detrimental engine emissions. Further, by using a piezo droplet generator 32, the overall efficiency of the engine system 10 may be improved by avoiding the energy required to highly pressurize the fuel via a fuel pump or equivalent device. Finally, the piezo droplet generator 32 may improve injector life by relieving the fuel injector 32 from certain operations.

The use of an exhaust-side piezo droplet generator 40 includes similar structural attributes to the piezo droplet generator 32 coupled to the engine 14. For example, exhaust-side piezo generator 40 may avoid more complex systems that could require a separate urea pump and associated components. In addition, by providing such small urea droplets (e.g., less than 25 microns), the efficiency of the catalyst-based device 42 may be improved, and the generator 40 may be located closer to catalyst-based device 42 because less space is needed to achieve a particular mixing of urea and exhaust. This reduction in the required mixing space may result in a savings of engine system space.

INDUSTRIAL APPLICABILITY

The disclosed system may be suitable to enhance efficiency and exhaust emissions in engine systems. The disclosed system may be used for any application of an engine. Such applications may include supplying power for machines, such as, for example, stationary equipment such as power generation sets, or mobile equipment, such as vehicles. The disclosed system may be used for any kind of vehicle, such as, for example, automobiles, construction machines (including those for on-road, as well as off-road use), and other heavy equipment.

It will be apparent to those having ordinary skill in the art that various modifications and variations can be made to the disclosed engine system without departing from the scope of the invention. Other embodiments of the invention will be apparent to those having ordinary skill in the art from consideration of the specification and practice of the invention disclosed herein. For example, exhaust system 16 may be reconfigured so that exhaust-side piezo droplet generator 40 may be used upstream of any type of after treatment device that may be assisted by the mixing of fluids. For example, injecting fuel into a diesel oxidation catalyst (not shown) to assist in regeneration of a particulate filter of the exhaust system 16 or upstream of a diesel particulate filter to raise the temperature of the exhaust to regeneration levels. As understood herein, an after treatment device may be any device that is located in the exhaust system 16 and assists in reducing harmful emissions. It is intended that the specification and examples be considered as exemplary only, with a true scope of the invention being indicated by the following claims and their equivalents.

What is claimed is:

1. An engine system, comprising:
an intake system;
an internal combustion engine; and
an exhaust system;
the internal combustion engine including
a fuel droplet generator, wherein the fuel droplet generator includes a piezo actuator, and
a fuel injector configured to inject fuel directly into a combustion chamber of the internal combustion engine.

2. The engine system of claim 1, wherein the fuel droplet generator is coupled to an intake manifold of the internal combustion engine.

3. The engine system of claim 1, wherein the droplet generator includes an injection element having at least 1220 outlet holes per square centimeter of the injection element.

4. The engine system of claim 1, wherein the droplet generator is configured to supply fuel droplets to the combustion chamber having a size of less than 7 microns.

5. The engine system of claim 1, further including a droplet generator located in the exhaust system.

6. The engine system of claim 5, wherein the droplet generator in the exhaust system includes a piezo actuator.

7. The engine system of claim 6, wherein the piezo actuated droplet generator is configured to supply a reagent to a downstream aftertreatment device.

8. The engine system of claim 7, wherein the piezo actuated droplet generator is configured to supply the aftertreatment device with urea droplets having a size of less than 25 microns.

9. An internal combustion engine, comprising:
an inlet manifold;
a combustion chamber;
an exhaust manifold; and
a piezo droplet generator located upstream of the combustion chamber, the piezo droplet generator including a plurality of outlet holes.

10. The internal combustion engine of claim 9, wherein the piezo droplet generator is coupled to an intake manifold of the internal combustion engine.

11. The internal combustion engine of claim 9, wherein the engine includes a plurality of said piezoelectric droplet generators and a plurality of combustion chambers, each piezo droplet generator associated with a corresponding combustion chamber.

12. The internal combustion engine of claim 9, wherein the piezo droplet generator is configured to supply fuel droplets to the combustion chamber having a size of less than 7 microns; and the internal combustion engine further includes a fuel injector configured to inject fuel directly into the combustion chamber.

13. An exhaust system of an engine system, comprising:

a piezo actuated droplet generator; and an aftertreatment device located downstream of the piezo droplet generator.

14. The exhaust system of claim 13, wherein the piezo actuated droplet generator is configured to supply reagent to the downstream aftertreatment device.

15. The exhaust system of claim 13, wherein the piezo actuated droplet generator is configured to supply the aftertreatment device with urea droplets having a size of less than 25 microns.

16. A method of operating an engine system, comprising:

supplying fuel from a piezo droplet generator to a combustion chamber of an internal combustion engine; and supplying fuel from a fuel injector to a combustion chamber of an internal combustion engine.

17. The method of claim 16, wherein only fuel from the piezo droplet generator is supplied to the combustion chamber during certain engine operating conditions.

18. The method of claim 17, wherein the operating condition is an idle condition.

19. The method of claim 16, wherein the supplying of fuel from the piezo droplet generator includes supplying fuel having a size of less than 7 microns.

20. A method of operating an engine system, comprising supplying reagent from a piezo actuated droplet generator to engine exhaust;

supplying a mixture of reagent and engine exhaust to an aftertreatment device.

21. The method of claim 20, wherein the reagent includes urea.

22. The method of claim 21, wherein the supplying of reagent from the piezo actuated droplet generator includes supplying urea having a size of less than 25 microns.

* * * * *